US007527512B2

(12) United States Patent
Montena

(10) Patent No.: US 7,527,512 B2
(45) Date of Patent: May 5, 2009

(54) CABLE CONNECTOR EXPANDING CONTACT

(75) Inventor: Noah Montena, Syracuse, NY (US)

(73) Assignee: John Mezza lingua Associates, Inc., East Syracuse, NY (US)

( * ) Notice: Subject to any disclaimer, the term of this patent is extended or adjusted under 35 U.S.C. 154(b) by 317 days.

(21) Appl. No.: 11/608,610

(22) Filed: Dec. 8, 2006

(65) Prior Publication Data

US 2008/0139047 A1 Jun. 12, 2008

(51) Int. Cl.
*H01R 13/62* (2006.01)
*H01R 13/15* (2006.01)
*H01R 9/05* (2006.01)

(52) U.S. Cl. ..... 439/265; 439/578; 29/861

(58) Field of Classification Search ..... 439/578, 439/265, 583, 584, 352, 825; 29/861, 874, 29/881, 882

See application file for complete search history.

(56) References Cited

U.S. PATENT DOCUMENTS

| | | | | | |
|---|---|---|---|---|---|
| 3,706,958 | A | | 12/1972 | Blanchenot | |
| 3,744,011 | A | | 7/1973 | Blanchenot | |
| 3,764,959 | A | | 10/1973 | Toma et al. | |
| 3,846,738 | A | | 11/1974 | Nepovim | |
| 4,346,958 | A | | 8/1982 | Blanchard | |
| 4,384,758 | A | * | 5/1983 | Lee et al. | 439/265 |
| 4,834,676 | A | | 5/1989 | Tackett | |
| 5,066,249 | A | | 11/1991 | Doye et al. | |
| 5,362,251 | A | | 11/1994 | Bielak | |
| 5,518,420 | A | * | 5/1996 | Pitschi | 439/578 |
| 6,133,532 | A | * | 10/2000 | Lundback et al. | 439/578 |
| 6,267,621 | B1 | | 7/2001 | Pitschi et al. | |
| 6,331,123 | B1 | | 12/2001 | Rodrigues | |
| 6,431,911 | B2 | * | 8/2002 | Pitschi | 439/583 |
| 6,478,618 | B2 | | 11/2002 | Wong | |
| 6,517,379 | B2 | | 2/2003 | Leve | |
| 6,634,906 | B1 | | 10/2003 | Yeh | |
| 6,705,884 | B1 | | 3/2004 | McCarthy | |
| 6,796,829 | B1 | | 9/2004 | McCarthy | |
| 6,848,941 | B2 | | 2/2005 | Wlos et al. | |
| 6,884,113 | B1 | | 4/2005 | Montena | |
| 6,955,561 | B2 | | 10/2005 | Seymour et al. | |
| 6,955,562 | B1 | | 10/2005 | Henningsen | |
| 7,008,264 | B2 | * | 3/2006 | Wild | 439/578 |
| 7,131,868 | B2 | | 11/2006 | Montena | |
| 7,357,671 | B2 | * | 4/2008 | Wild et al. | 439/583 |
| 2007/0105439 | A1 | | 5/2007 | Burris | |

* cited by examiner

*Primary Examiner*—Felix O Figueroa
(74) *Attorney, Agent, or Firm*—Christopher R. Pastel; Pastel Law Firm

(57) ABSTRACT

An expanding contact used within a cable connector to make a solid connection with a hollow center conductor of a coaxial cable includes two pieces, a pin and a guide. The pin includes a plurality of slots which form a like plurality of fingers, while the guide includes a plurality of tabs which fit into the plurality of slots. Ends of the fingers include a ramped portion which interacts with a ramped portion of the guide. When the pin is pushed against the guide, the fingers are pushed outward because of the ramped portions of the fingers sliding against the ramped portion of the guide. Before the ends are pushed outward, the pin/guide combination can slide easily into and out of the hollow center conductor, but when the fingers are pushed outward, the fingers make a substantial interference fit with the inner walls of the hollow center conductor.

12 Claims, 5 Drawing Sheets

CABLE CONNECTOR EXPANDING CONTACT

FIELD OF THE INVENTION

This invention relates generally to the field of coaxial cable connectors, and more particularly to an expanding contact within a coaxial cable connector for use with hollow center conductor coaxial cables.

BACKGROUND OF THE INVENTION

Some coaxial cables have hollow center conductors, primarily as a cost savings, but partially to improve bending and manipulation of the cable. Performance is not affected because the radio frequencies used in coaxial cable travel only on the outermost layer of the conductor. Hollow center conductors allow making pin contact with the inner wall of the center conductor, which permits flush cutting of the cable conductors and dielectric upon installation rather than stripping the outer cable layers off to expose a section of solid inner conductor to permit pin contact with the outer surface of the solid center conductor.

Most components which make contact with hollow center conductors use slotted pins which obtain their contact force from the cantilevered beams formed by the pin fingers that result from forming the slots in the pins. Although good contact is achieved, the force applied by the fingers is present during the insertion process, thus creating high drag throughout the process.

SUMMARY OF THE INVENTION

Briefly stated, an expanding contact used within a cable connector to make a solid connection with a hollow center conductor of a coaxial cable includes two pieces, a pin and a guide. The pin includes a plurality of slots which form a like plurality of fingers, while the guide includes a plurality of tabs which fit into the plurality of slots. Ends of the fingers include a ramped portion which interacts with a ramped portion of the guide. When the pin is pushed against the guide, the fingers are pushed outward because of the ramped portions of the fingers sliding against the ramped portion of the guide. Before the ends are pushed outward, the pin/guide combination can slide easily into and out of the hollow center conductor, but when the fingers are pushed outward, the fingers make a substantial interference fit with the inner walls of the hollow center conductor.

According to an embodiment of the invention, a coaxial cable connector expanding contact includes a pin; a guide; the pin including a plurality of fingers defined by a plurality of slots; the guide including a plurality of tabs which fit into the plurality of slots; each finger including an end, wherein the ends of the fingers include a ramped portion; and the guide including a ramped section; wherein when the pin is pushed against the guide, the ends of the fingers are pushed radially outward because of the ramped portions of the fingers sliding against the ramped section of the guide.

According to an embodiment of the invention, a method for manufacturing a coaxial cable connector expanding contact includes the steps of forming a pin; forming a guide; forming a plurality of slots in the pin to define a plurality of fingers; forming a plurality of tabs on the guide which fit into the plurality of slots; forming a ramped portion on each end of the fingers; and forming a ramped section on the guide; wherein when the pin is pushed against the guide, the ends of the fingers are pushed radially outward because of the ramped portions of the fingers sliding against the ramped section of the guide.

According to an embodiment of the invention, a method for connecting a cable connector to a coaxial cable, wherein the coaxial includes a hollow center conductor, and wherein the cable connector includes a pin; a guide; a plurality of slots in the pin to define a plurality of fingers; a plurality of tabs on the guide which fit into the plurality of slots; a ramped portion on each end of the fingers; and a ramped section on the guide, includes the steps of clamping a prepared end of the coaxial cable within the cable connector; and pushing the pin against the guide such that the ends of the fingers are pushed radially outward because of the ramped portions of the fingers sliding against the ramped section of the guide.

DETAILED DESCRIPTION OF THE PREFERRED EMBODIMENT

Figure 1:
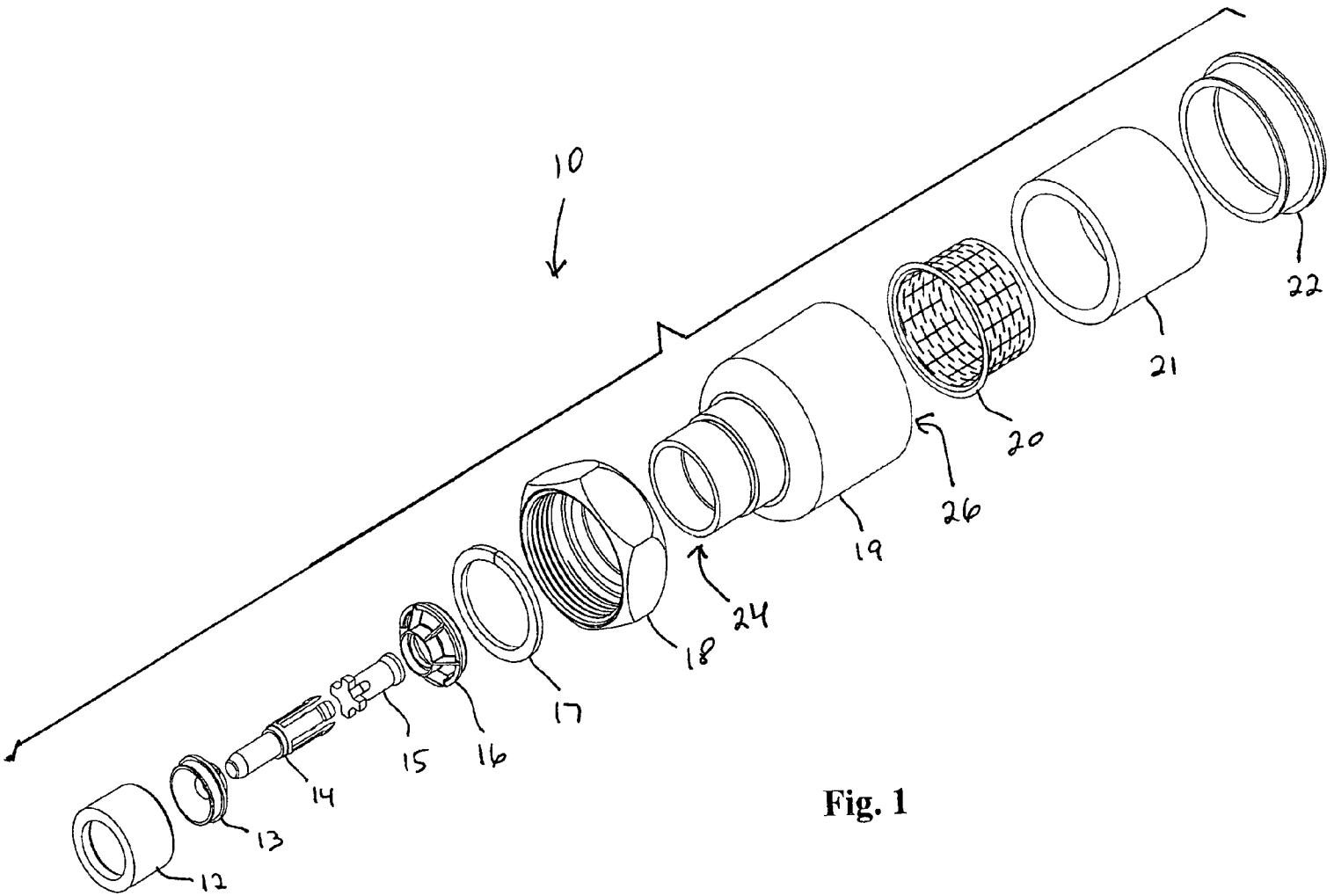
FIG. 1 shows a perspective exploded view of the parts of a coaxial cable connector according to an embodiment of the invention.

Referring to FIG. 1, a coaxial cable connector 10 according to an embodiment of the invention is shown in exploded form. One way of assembling cable connector 10 is to place a fastener 18 onto an outer body 19 and hold it in place with a snap ring 17. A guide 15 is positioned partly within a pin 14, after which the guide/pin combination is positioned within an insulator 16. An insulator 13 is then positioned over pin 14. A sliding retainer 12 fits over insulator 13 and the entire assembly up to this point is inserted into an end 24 of outer body 19. A mesh body 20 is inserted into an end 26 of outer body 19, followed by an elastomeric clamp 21 and a compression sleeve 22. In the embodiment shown, sliding retainer 12 is preferably of a conductive material such as metal, and is preferably press-fit into outer body 19 during installation. If there is adequate electrical contact between outer body 19 and fastener 18, sliding retainer 12 need not be electrically conductive.

Figure 2:
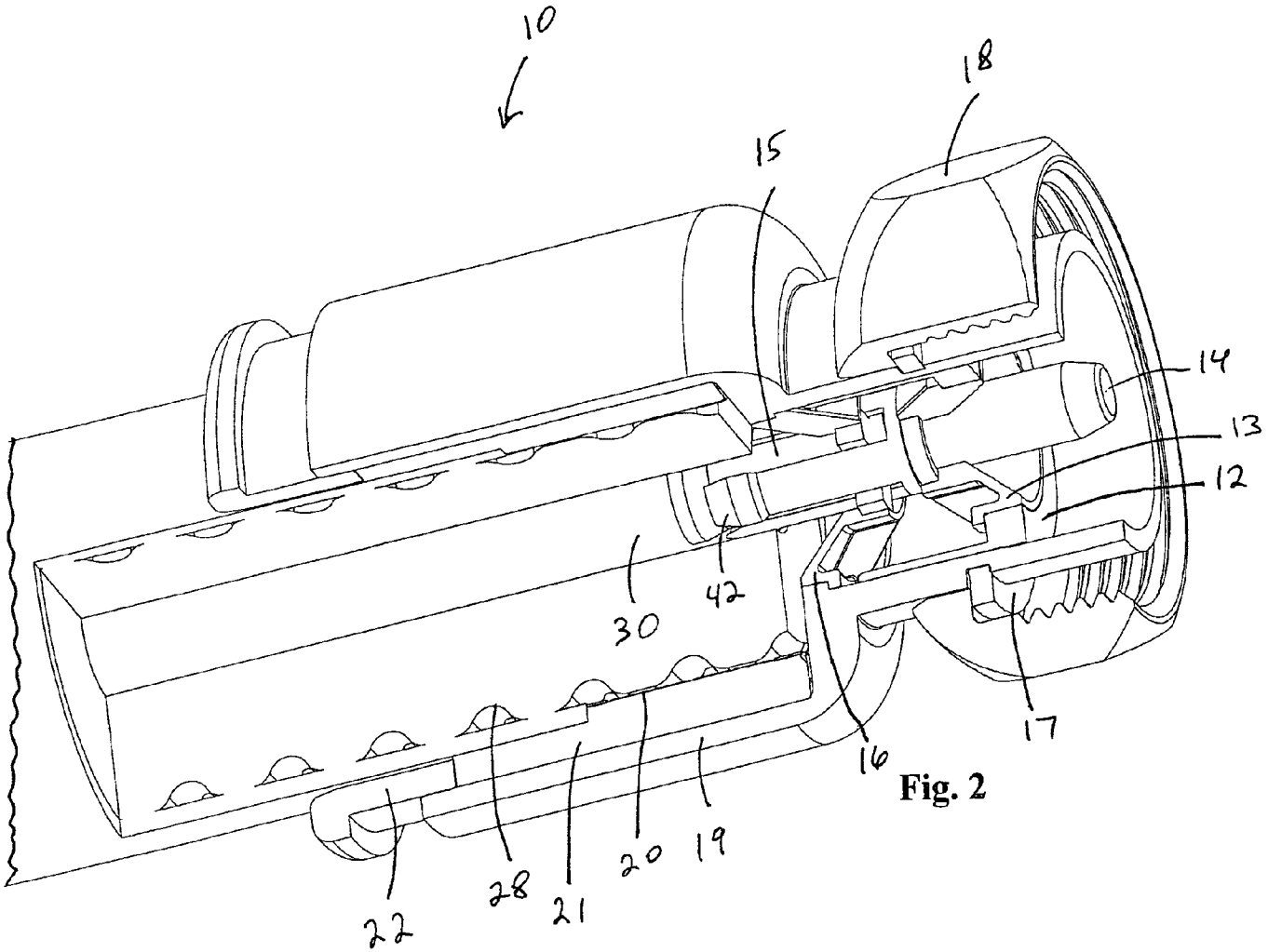
FIG. 2 shows a partial cutaway perspective view of a coaxial cable connector according to an embodiment of the invention which is in its first position of clearance within a hollow center conductor of a coaxial cable.

Referring also to FIG. 2, a cable 28 which has a hollow center conductor 30 is attached to cable connector 10 as follows. Mesh body 20, elastomeric clamp 21, and compression sleeve are removed from outer body 19. Cable 28 is inserted through compression sleeve 22, elastomeric clamp 21, and mesh body 20 in that order, with mesh body 20 as close to the end of cable 28 as possible. Cable 28 is then positioned inside outer body 19 and compression sleeve 22 is forced into outer body 19, squeezing elastomeric clamp 21 into the corrugated surface of cable 28 and holding cable 28 in place as the result of axial compression of compression sleeve 22.

Figure 4:
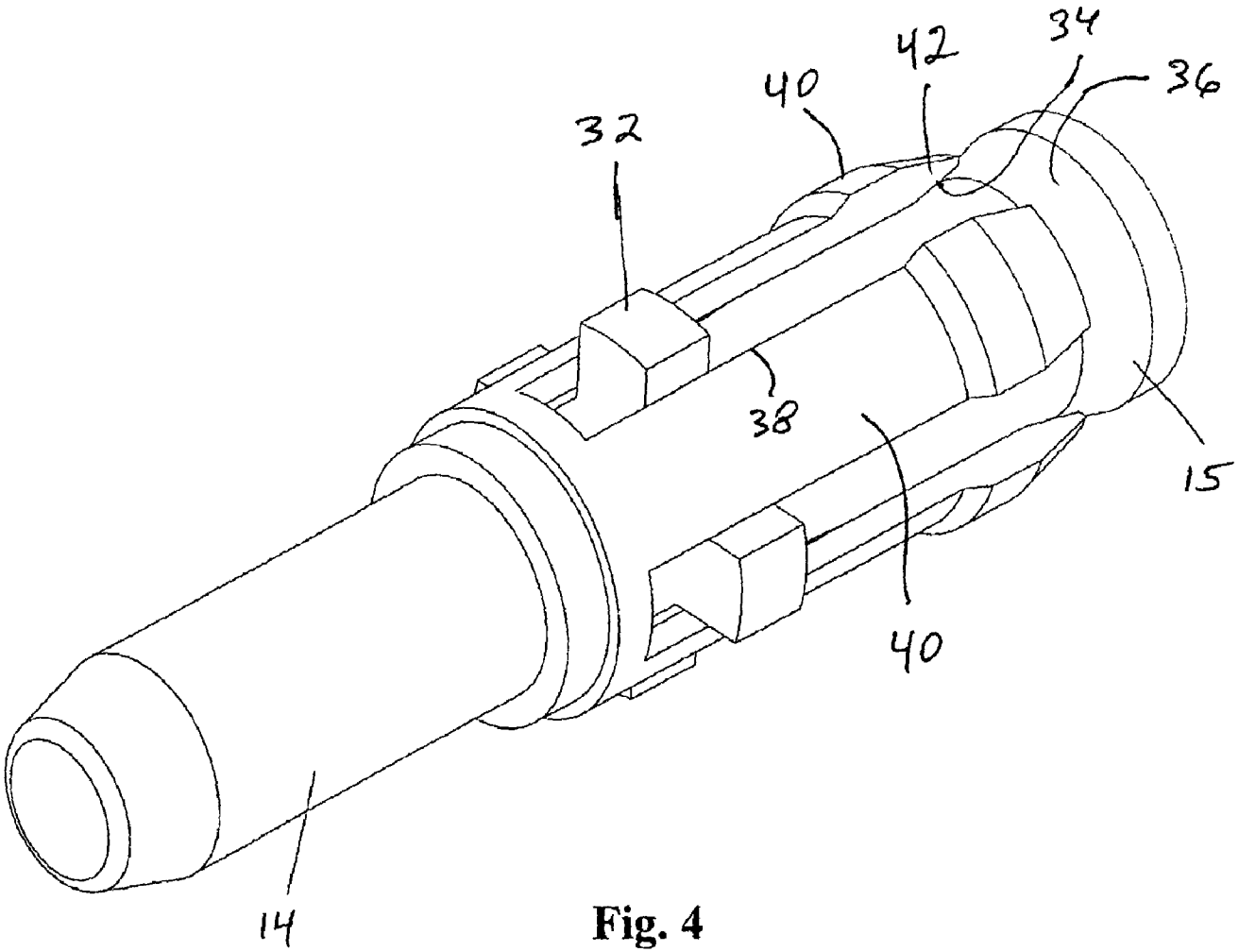
FIG. 4 shows a perspective view of a cable connector expanding contact according to an embodiment of the present invention in its clearance position.

Referring now to FIG. 4, guide 15 is shown inside pin 14 in what is referred to herein as the first position of clearance. The term "first position of clearance" refers to the fact that the pin 14/guide 15 combination in this position will slide easily into and out of hollow center conductor 30 of cable 18 (FIG. 2).

Pin 14 includes a plurality of slots 38 which create a like plurality of fingers 40, while guide 15 includes a plurality of corresponding tabs 32, preferably one-piece with guide 15, which hold guide 15 within pin 14 and preferably make secure contact with insulator 16. Each finger 40 includes a ramped portion 34 on an underside of an end 42 which interacts with a ramped portion 36 of guide 15.

Figure 5:
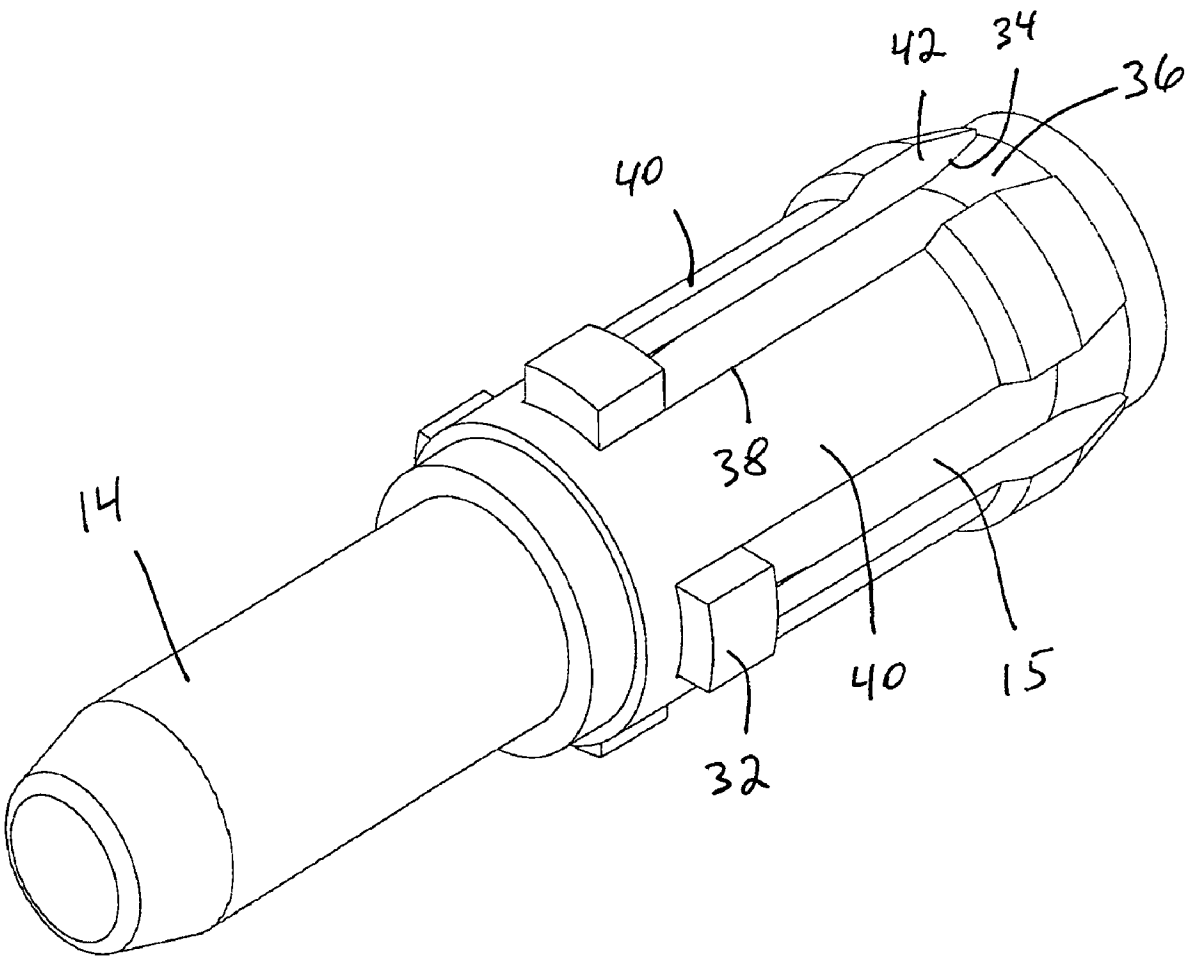
FIG. 5 shows a perspective view of a cable connector expanding contact according to an embodiment of the present invention in its interference position.

Referring to FIG. 5, the pin 14/guide 15 combination is shown in the second position of interference. the term "second position of interference" refers to the fact that the pin 14/guide 15 combination does not slide easily into and out of hollow center conductor 30 of cable 18 (FIG. 2) because ends 42 of fingers 40 have been pushed outward by ramped portions 34 interacting with ramped portion 36 when pin 14 is pushed further against guide 15.

Referring back to FIG. 2, the pin 14/guide 15 combination is shown in the first position of clearance. In the figure, a portion of center conductor 30 is cut away to show the placement of end 42 and ramped portion 36 of the pin 14/guide 15 combination inside hollow center conductor 30. At this stage, there is no interference fit between fingers 40 and the inside of center conductor 30.

Referring back to FIG. 3, the pin 14/guide 15 combination is shown in the second position of interference. Note that ends 42 of fingers 40 are moved further rearward and outward than in FIG. 2, thus creating an excellent interference fit with center conductor 30.

Figure 3:
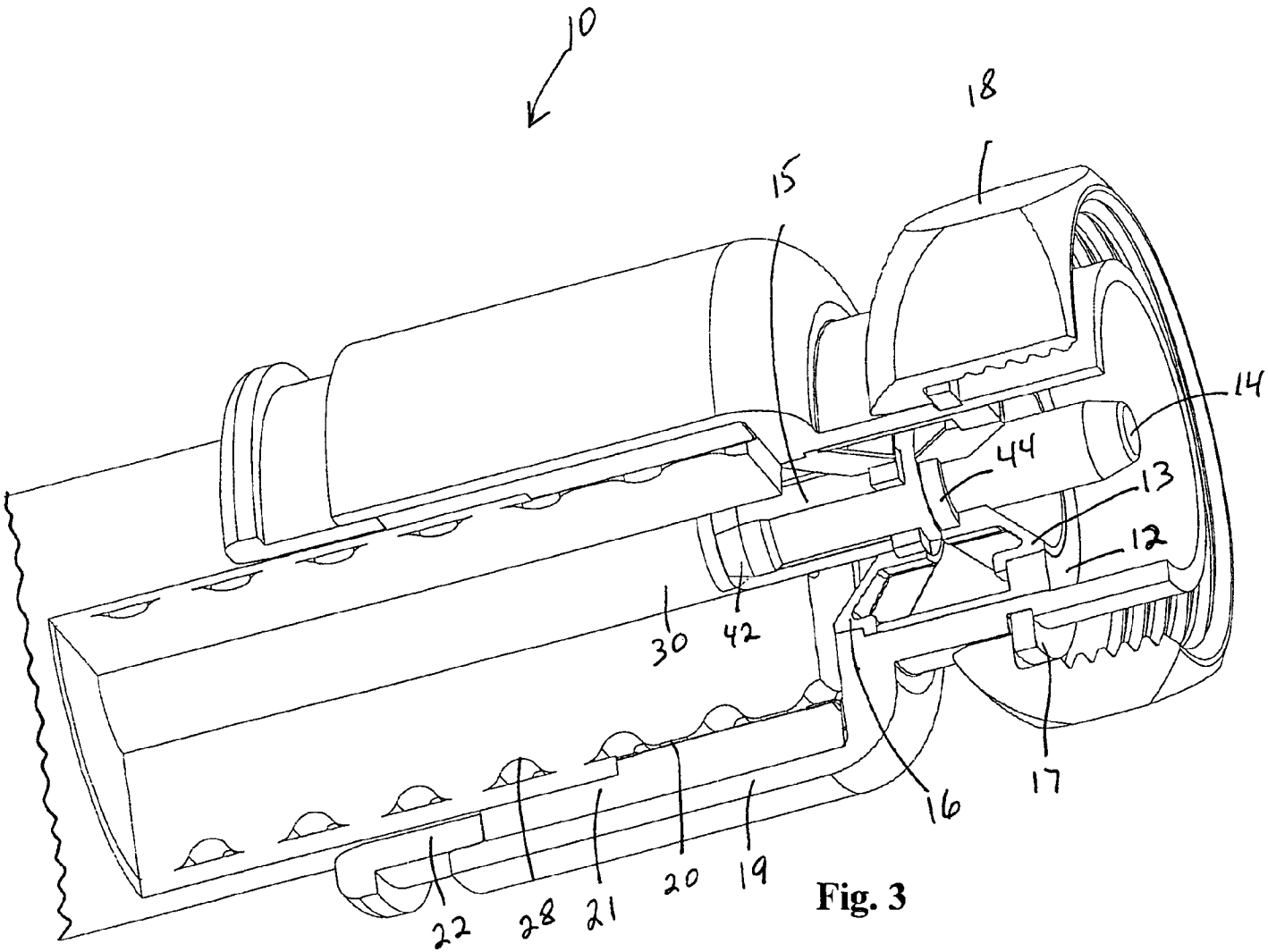
FIG. 3 shows a partial cutaway perspective view of the coaxial cable connector of FIG. 2 which is in its second position of interference within the hollow center conductor of a coaxial cable.

Referring now to FIGS. 2-3, in the embodiment shown, pin 14 is preferably moved rearward indirectly by pressing against sliding retainer 12 with a special compression tool (not shown) that provides axial force against sliding retainer 12. Sliding retainer 12 in turn pushes against insulator 13 which in turn pushes against a ridge 44 on pin 14. Alternatively, the tool could push directly against pin 14 or insulator 13. In the embodiment shown, guide 15 is held axially immovable relative to connector 10 by insulator 16.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A coaxial cable connector expanding contact, comprising:

a pin;

a guide;

the pin including a plurality of fingers defined by a plurality of slots;

the guide including a plurality of tabs which fit into the plurality of slots;

each finger including an end, wherein the ends of the fingers include a ramped portion; and the guide including a ramped section;

wherein when the pin is pushed against the guide, the ends of the fingers are pushed radially outward because of the ramped portions of the fingers sliding against the ramped section of the guide.

2. An apparatus according to claim 1, wherein the pin and the guide are components of a cable connector which connects to a coaxial cable having a hollow center conductor;

wherein before the ends of the fingers are pushed radially outward, the pin and the guide are movable into and out of the hollow center conductor without resistance, and when the ends of the fingers are pushed radially outward, the ends of the fingers make a substantial interference fit with an inner wall of the hollow center conductor.

3. An apparatus according to claim 2, wherein the cable connector includes an insulator, and the tabs make contact with the insulator to hold both the pin and the guide radially centered within the cable connector.

4. An apparatus according to claim 3, further comprising an annular ridge on the pin approximately adjacent a closed end of a slot.

5. A method for manufacturing a coaxial cable connector expanding contact, comprising the steps of:

forming a pin;

forming a guide;

forming a plurality of slots in the pin to define a plurality of fingers;

forming a plurality of tabs on the guide which fit into the plurality of slots;

forming a ramped portion on each end of the fingers; and forming a ramped section on the guide;

wherein when the pin is pushed against the guide, the ends of the fingers are pushed radially outward because of the ramped portions of the fingers sliding against the ramped section of the guide.

6. A method according to claim 5, wherein the pin and the guide are components of a cable connector which connects to a coaxial cable having a hollow center conductor;

wherein before the ends of the fingers are pushed radially outward, the pin and the guide are movable into and out of the hollow center conductor without resistance, and when the ends of the fingers are pushed radially outward, the ends of the fingers make a substantial interference fit with an inner wall of the hollow center conductor.

7. A method according to claim 6, further comprising the step of forming an insulator as part of the cable connector, such that the tabs make contact with the insulator to hold the pin and the guide radially centered within the cable connector.

8. A method according to claim 7, further comprising the step of forming an annular ridge on the pin approximately adjacent a closed end of a slot.

9. A method for connecting a cable connector to a coaxial cable, wherein the coaxial includes a hollow center conductor, and wherein the cable connector includes a pin; a guide; a plurality of slots in the pin to define a plurality of fingers; a plurality of tabs on the guide which fit into the plurality of slots; a ramped portion on each end of the fingers; and a ramped section on the guide, comprising the steps of:

clamping a prepared end of the coaxial cable within the cable connector; and pushing the pin against the guide such that the ends of the fingers are pushed radially outward because of the ramped portions of the fingers sliding against the ramped section of the guide.

10. A method according to claim 9, wherein before the step of pushing, the pin and the guide are movable into and out of the hollow center conductor without resistance, and after the step of pushing, the ends of the fingers make a substantial interference fit with an inner wall of the hollow center conductor.

11. A method according to claim 10, wherein the step of pushing includes the step of applying axial force directly against the pin.

12. A method according to claim 10, wherein the step of pushing includes the step of applying axial force indirectly against the pin via applying axial force directly to a different component of the cable connector which in turn applies axial force directly against the pin.

* * * * *